US011485391B2

(12) United States Patent
Nilsson

(10) Patent No.: US 11,485,391 B2
(45) Date of Patent: Nov. 1, 2022

(54) TRAIN COUPLER CONNECTOR MODULE FOR ELECTRICALLY CONNECTING A FIRST RAIL VEHICLE TO A SECOND RAIL VEHICLE

(71) Applicant: DELLNER COUPLERS AB, Falun (SE)

(72) Inventor: Bo Nilsson, Falun (SE)

(73) Assignee: DELLNER COUPLERS AB, Falun (SE)

( * ) Notice: Subject to any disclaimer, the term of this patent is extended or adjusted under 35 U.S.C. 154(b) by 420 days.

(21) Appl. No.: 16/631,260

(22) PCT Filed: Jun. 28, 2018

(86) PCT No.: PCT/SE2018/050709
§ 371 (c)(1),
(2) Date: Jan. 15, 2020

(87) PCT Pub. No.: WO2019/017826
PCT Pub. Date: Jan. 24, 2019

(65) Prior Publication Data

US 2020/0207383 A1 Jul. 2, 2020

(30) Foreign Application Priority Data

Jul. 19, 2017 (SE) ..... 1750948-0

(51) Int. Cl.
*B61G 5/06* (2006.01)
*B61G 5/10* (2006.01)
(Continued)

(52) U.S. Cl.
CPC ..... *B61G 5/10* (2013.01); *H01R 9/2408* (2013.01); *H01R 13/514* (2013.01); *H01R 24/84* (2013.01); *H01R 2201/26* (2013.01)

(58) Field of Classification Search
CPC ..... B61G 5/06; B61G 5/10; H01R 9/2408; H01R 13/514; H01R 24/84; H01R 2201/26
(Continued)

(56) References Cited

U.S. PATENT DOCUMENTS 5,580,275 A 12/1996 Bozek
5,658,159 A 8/1997 Gardner et al.
(Continued)

FOREIGN PATENT DOCUMENTS

CN 104617456 A 5/2015
DE 202011050247 8/2012
(Continued)

OTHER PUBLICATIONS

International Search Report, PCT/SE2018/050709, dated Jul. 13, 2018.
(Continued)

*Primary Examiner* — Khiem M Nguyen
(74) *Attorney, Agent, or Firm* — Nixon & Vanderhye

(57) ABSTRACT

Disclosed is a train coupler connector module for electrically coupling a first rail vehicle to a second rail vehicle, the module including: a fixing block with an inner side able to be mounted on an electrical train coupler; a plurality of contact units arranged side by side in the fixing block, each contact unit having a first end facing the inner side of the fixing block and a second end extending outwards from the fixing block, one of the first and second end being a female contact and the other being a male contact; wherein at least one of the contact units is arranged to be individually removable from the fixing block in a direction outwards from the fixing block.

13 Claims, 4 Drawing Sheets

Figure 1B:
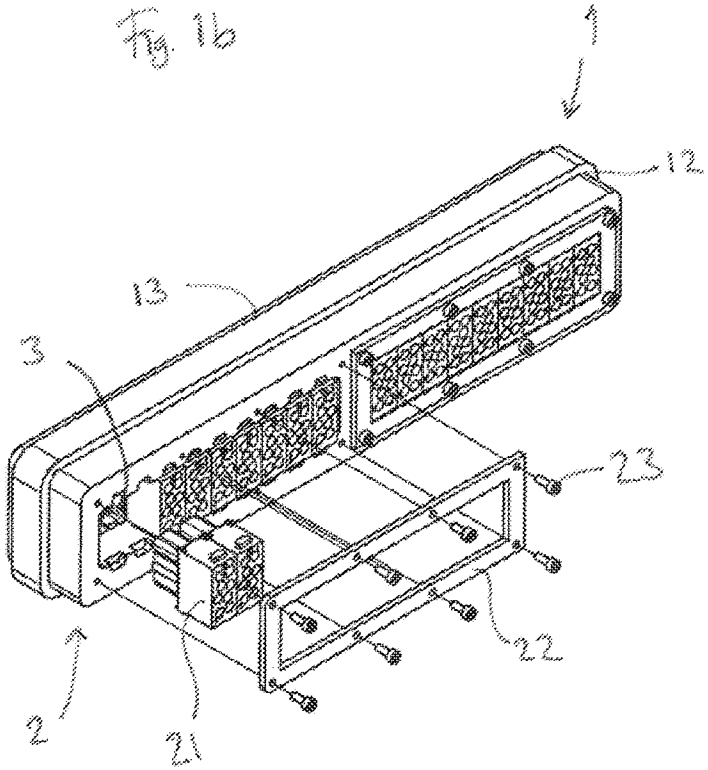

(51) Int. Cl.
*H01R 9/24* (2006.01)
*H01R 13/514* (2006.01)
*H01R 24/84* (2011.01)

(58) Field of Classification Search
USPC ..... 213/1.3; 439/660, 701
See application file for complete search history.

(56) References Cited

U.S. PATENT DOCUMENTS

| | | | | |
|---|---|---|---|---|
| 8,348,074 | B2 | 1/2013 | Dahlstrom et al. | |
| 2007/0093112 | A1 | 4/2007 | Macey | |
| 2010/0326942 | A1 | 12/2010 | Dahlstrom et al. | |
| 2020/0207383 | A1* | 7/2020 | Nilsson ..... | H01R 9/2408 |

FOREIGN PATENT DOCUMENTS

| | | | |
|---|---|---|---|
| DE | 202012103360 | | 1/2013 |
| EP | 2125478 | | 9/2016 |
| EP | 3067993 | | 9/2016 |
| FR | 3 022 701 | A1 | 12/2015 |
| GB | 2 356 743 | A | 5/2001 |
| WO | WO 2005/034300 | | 4/2005 |
| WO | WO2008/100221 | | 8/2008 |

OTHER PUBLICATIONS

Written Opinion, PCT/SE2018/050709, dated Jul. 13, 2018.
Extended European Search Report issued in European Patent Application No. 18834947.6 dated Mar. 10, 2021.
CN Office Action, dated Nov. 23, 2020, from corresponding CN Application No. 201880047856.0.

* cited by examiner

TRAIN COUPLER CONNECTOR MODULE FOR ELECTRICALLY CONNECTING A FIRST RAIL VEHICLE TO A SECOND RAIL VEHICLE

TECHNICAL FIELD

The present invention relates to a train coupler connector module for electrically coupling a first rail vehicle to a second rail vehicle, the module comprising:

a fixing block with an inner side able to be mounted on an electrical train coupler, and a plurality of contact units arranged side by side in the fixing block, each contact having a first end facing the inner side of the fixing block and a second end extending outwards from the fixing block.

BACKGROUND

Signals between trains or cars of a train are generally transferred via an electrical coupler that is connected to the mechanical coupler. Once the mechanical connection is established, protective lids on the electrical heads of either train car opens and the heads are engaged and coupled to each other to allow electrical current to flow from one train car to the next. The electrical heads generally comprise various electrical contacts which are placed inside an insulating connection block. The most common types of connector pairs are pin/sleeve, fixed/spring loaded, or spring-loaded/spring-loaded. The contacts are crimped to signal cables at the back side and screwed into the contact block from the rear. To ease maintenance the contacts are divided into a contact holder, which is screwed into the contact block, and a contact member that is screwed into the contact holder. The contact member can be exchanged from the front without dismounting the contact block, Such a solution is disclosed by EP2125478. One serious disadvantage of this technology is the cost for each of the individual connectors, resulting in high expenses each time a connector breaks and needs to be replaced.

One solution to this problem is the use of larger modules, bringing the cost for each replacement down compared to the individual connectors. However, replacing the modules is a cumbersome and time consuming business, since the contact block itself needs to be dismantled to expose the modules and each cable leading up to the module will need to be reconnected to the new module.

There is therefore a need for a more cost and time efficient solution that reduces wear to the contacts and allows for easier maintenance of the electrical coupler of a train coupler.

SUMMARY OF THE INVENTION

The object of the present invention is to eliminate or at least to minimize the problems mentioned above. This is achieved through a train coupler connector module according to the appended independent claim. Through the use of replaceable modules connectable to the contact members of the electrical coupler a protection from wear is achieved and due to the modular properties and placement of the connector module replacing modules becomes easy and time efficient.

According to an aspect of the invention, the fixing block is arranged to hold each contact unit with either the female contact or the male contact facing towards the back side. Thus, due to the contact units having both female and male contacts the contact unit can be mounted in the fixing block with either the female or the male contact protruding, giving versatility to the connector module and enabling the same contact units to be used regardless of the configuration of the contact members of the electrical couplers.

According to another aspect of the invention, the fixing block is permanently fixed to an electrical train coupler. Thereby, the connector module can form a permanent part of the electrical train coupler and does not have to be applied separately. Where a protective lid is provided to protect the contact members that lid can also cover the connector module, protecting it from dirt and from the surrounding environment.

Many additional benefits and advantages of the invention will become readily apparent to the person skilled in the art in view of the detailed description below.

DRAWINGS

Figure 1A:
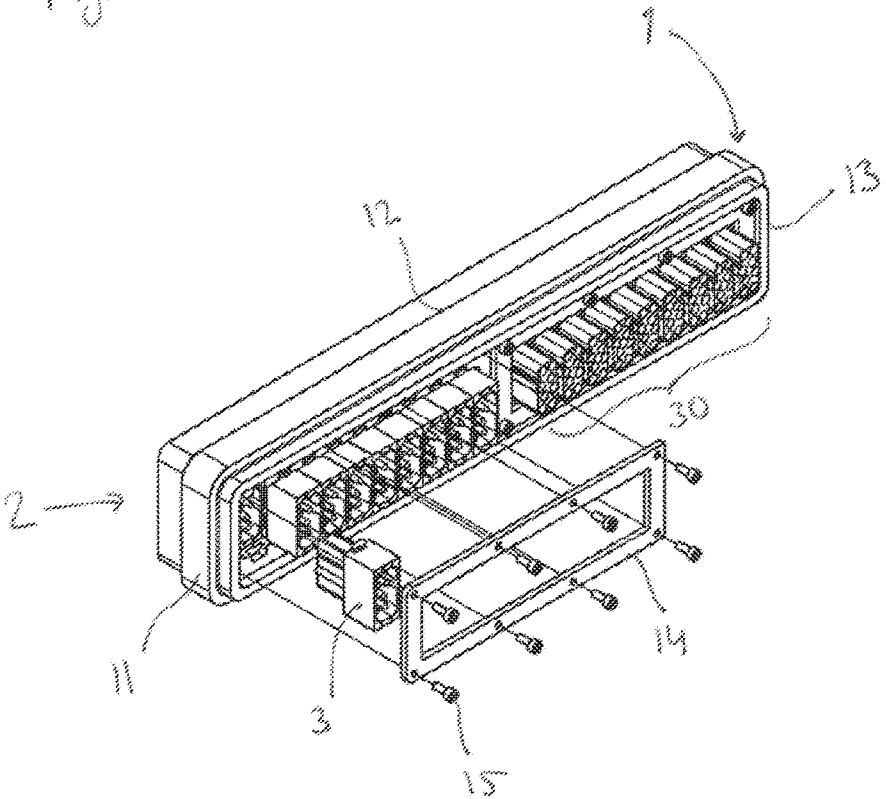
Figure 2C:
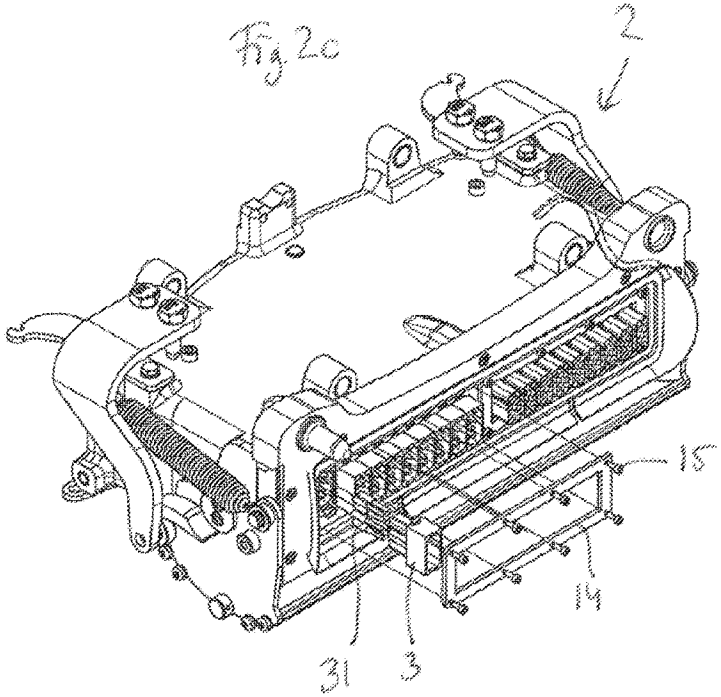
Figure 2A:
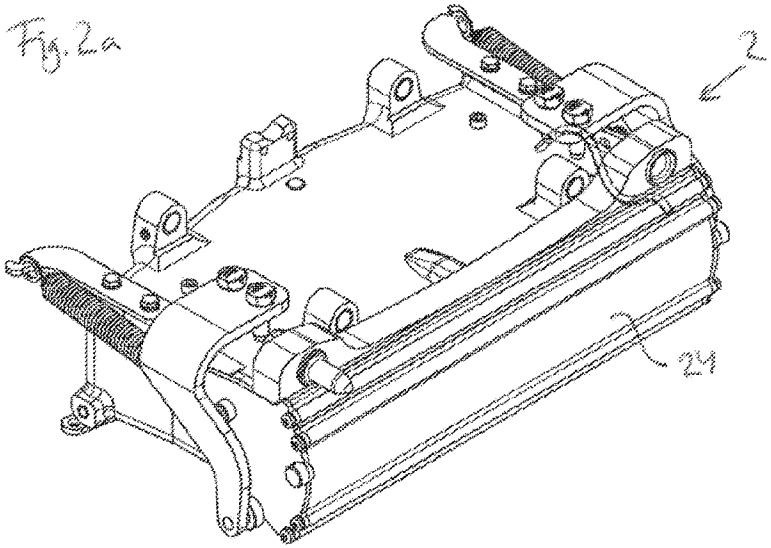
Figure 2B:
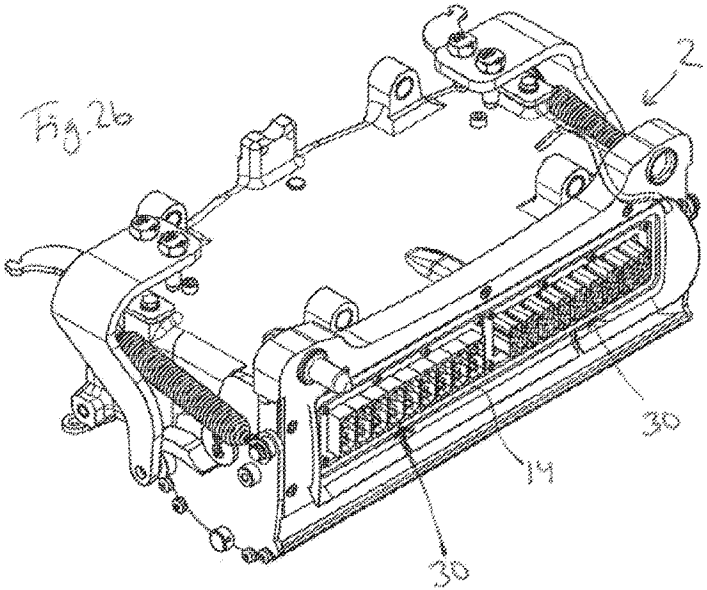
Figure 3A:
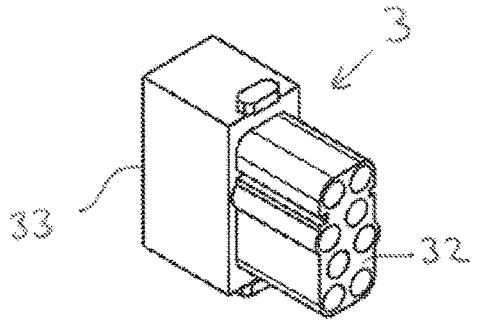
Figure 3B:
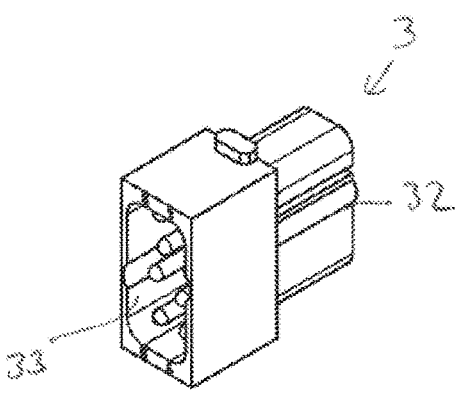
Figure 3C:
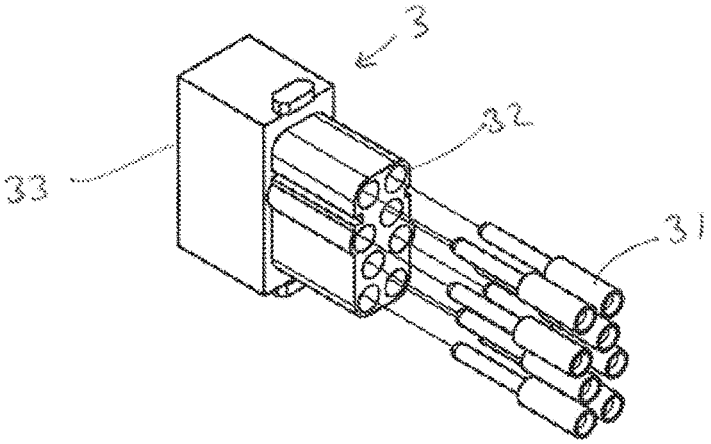
Figure 4B:
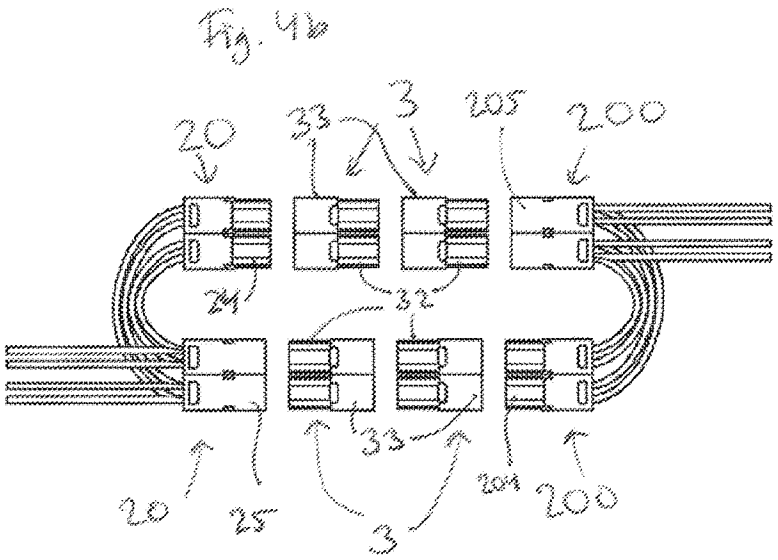
Figure 4A:
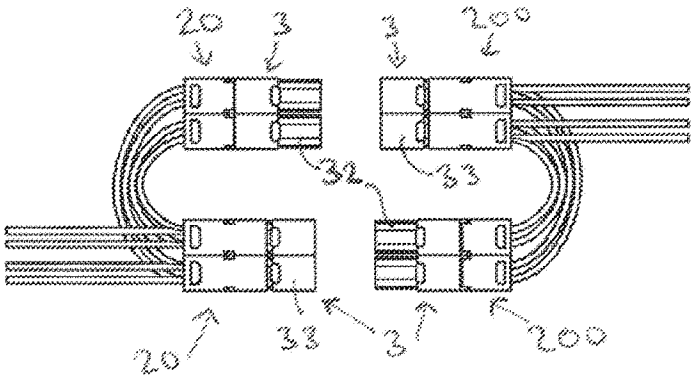
Figure 4C:
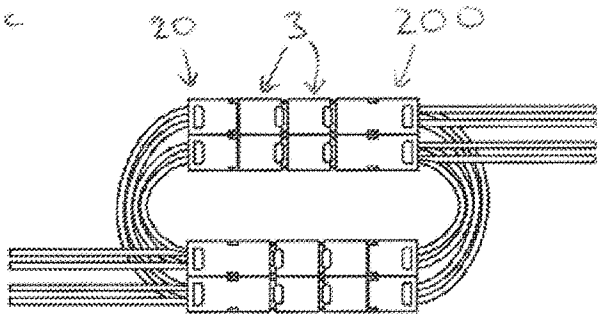

The invention will now be described in more detail with reference to the appended drawings, wherein:

FIG. 1*a* discloses a train coupler connector module according to a preferred embodiment of the invention in a perspective view from the front;

FIG. 1*b* discloses the connector module of FIG. 1*a* in a perspective view from the back, from the inside of an electrical coupler;

FIG. 2*a* discloses a perspective view of an electrical coupler fitted with the connector module of FIG. 1 and a protective lid;

FIG. 2*b* discloses the electrical coupler of FIG. 2*a* with the lid open;

FIG. 2*c* discloses the electrical coupler of FIGS. 2*a* and 2*b* during replacement of contact units in the connector module;

FIG. 3*a* discloses a perspective view of a contact unit of the connector module from a first end;

FIG. 3*b* discloses a perspective view of a contact unit of the connector module from a second end;

FIG. 3*c* discloses a perspective view of a contact unit of the connector module with contacts removed;

FIG. 4*a* discloses a schematic planar view of two electrical couplers without connector module;

FIG. 4*b* discloses a schematic planar view of the electrical couplers of FIG. 4*a* with contact units of a connector module provided between them; and FIG. 4*c* discloses a schematic planar view of the electrical couplers of FIGS. 4*a* and 4*b*, the couplers being connected to each other via contact units.

DETAILED DESCRIPTION

Train couplers are well known within the art and the main design and function of the electrical coupling of two rail vehicles will in the following be described only briefly.

A train coupler generally comprises a drawbar and a coupler head. In operation, the drawbar is attached to a rail vehicle chassis and the coupler head is arranged for coupling to a corresponding coupler head of a meeting train coupler. The electrical connection between the rail vehicles is performed through connection of electrical coupler heads provided on the coupler heads on each of the rail vehicles.

The electrical head comprises a connection block supported on the coupler head and comprising a multiplicity of connectors facing forward in a front face of the connection block. In operation, a bunch of conductors will extend from the rail vehicle to a rear face of the connection block and be individually connected to the connectors. The arrangement of connection block and connectors provides automatic connection with mating connectors in a corresponding connection block upon coupling to a meeting and correspondingly equipped train coupler. Thus in the connected mode, the connection block and connectors transfer electrical power and signals between the interconnected rail vehicles.

The connectors that are supported in the connection block can generally be explained to include a female shape contact and a male shape contact that are connectable in a coaxial relation and that are operable for transfer of electrical power and/or signals for operation control between interconnected rail vehicles. In order to serve a rising number of functions in rail vehicles, the connectors are designed to be accommodated in a large quantity in the connection block. The connectors are typically arranged in parallel horizontal and vertical rows.

The connector module according to the present invention will now be described in more detail with reference to the drawings.

Thus, FIG. 1*a* discloses a connector module 1 from a front side 13 and FIG. 1*b* shows the same connector module 1 from a back side 12. The connector module 1 comprises a fixing block 11 inside which at least one contact unit group 30 is mounted. The contact unit group 30 comprises a plurality of individual contact units 3. Each contact unit 3 is inserted from the front side 13 and connects to a connector 21 of connection block 2 of an electrical coupler head (of which only a part on which the connector module 1 is mounted is shown in the Figure). The contact units 3 are fixed by a fixing frame 14 screwed onto the front side 13 of the connector module 1 with a plurality of screws 15 to prevent them coming loose during use. One or more contact units 3 can be individually replaced by removing the fixing frame 14 and removing the contact unit 3 from the fixing block 11 in a direction outwards from the fixing block 11.

FIG. 1*b* shows the fixing block 11 fixedly mounted on the connection block 2 (only a small portion is shown). The connection block 2 comprises a plurality of connectors 21 that here are fixed to the connection block 2 by a second fixing frame 22 fastened with a plurality of screws 23. One of the contact units 3 can be seen through an opening in the connection block 2 to further illustrate how the connectors 21 mate with the contact units 3.

FIG. 2*a* shows the connection block 2 with a protective lid 24 covering the contact units 3 in order to protect them when the electrical coupler is not in use. In FIG. 2*b*, the lid has been opened downwards in the Figure to reveal the contact units 3 and the fixing frame 14. The connector module 1 has thus been mounted on the connection block 2 in such a way that each of the contact units 3 is connected to one connector 21 of the connection block 2 and thereby protects the connectors 21 from wear and tear resulting from coupling and uncoupling multiple times. As can also be seen in FIG. 2*b*, some of the individual contact units 3 are turned in such a way that the female end protrudes out from the electrical coupler and some are arranged with the male end protruding instead.

FIG. 2*c* shows the electrical coupler during replacement of one of the connector modules 3, where the fixing frame 14 has been removed by loosening the screws 15 to provide access to the plurality of contact units 30. One of the contact units 3 has been removed by pulling on the contact unit 3. Also, individual pin/socket contacts 31 held inside the contact unit 3 have been removed.

FIG. 3*a* illustrates an individual contact unit 3 having a first end 32 and a second end 33. The first end 32 comprises a female contact and the second end 33 comprises a male. In FIG. 3*b*, the second side 33 with the male contact is shown, comprising a plurality of pins whereas the first side 32 with the female contact comprises matching sockets. This configuration allows for using the same type of contact unit 3 regardless of a male or female connection is to be provided. FIG. 3*c* shows the contact unit 3 with the pin/socket contacts 31 removed, both to illustrate the ease with which individual faulty pin/sockets can be replaced and to show how they in this contact unit 3 extends from the first end 32 to the second end 33 and are removable through one of these ends.

FIG. 4*a*-4*c* shows schematically the coupling of a first coupler 20 to a second coupler 200. In these Figures only a few of the connectors are shown to illustrate the main operating principles of the present invention. In FIG. 4*a*, the first coupler 20 has some connectors with female contacts 24 and some with male contacts 25. To each of these contacts, a contact unit 3 is connected and able to be used for coupling the first coupler 20 to the second coupler 200. Similarly, the second coupler 200 comprises connectors with female contacts 204 or with male contacts 205, to which contact units 3 are connected. FIG. 4*b* further illustrates this by showing each contact unit 3 removed from the first and second couplers 20, 200, having itself female contacts 32 and male contacts 33 that are arranged to correspond to each of the first and second couplers 20, 200. FIG. 4*c*, lastly, shows the first and second couplers 20, 200 coupled to each other with the contact units 3 of each being coupled to each other. These Figures are only to demonstrate the operating principle and therefore lacks other components that would be present in an application in an electrical coupler, such as the fixing block, fixing frame and other features of the connector module 1 as a whole, together with the connection block 2 and other components of the electrical coupler of a rail vehicle.

Preferably, the connector module 1 is fixedly attached to the connector block 2, but in some embodiments it would also be possible to have the connector module 1 removable and to thereby enable the replacement of the entire connector module 1. In the preferred embodiment described above, each contact unit 3 would be replaced individually and without requiring removal of any of the other contact units 3 in the group of contact units 30. In other embodiments the individual contact units 30 could also be fixedly mounted together in larger units of a number of contact units, for example the contact unit group 30.

The ability to remove the individual contact units 3 from the front end of the electrical coupler and to replace a faulty contact unit 3 or even individual faulty pin/socket contacts inside the contact unit 3 is an advantage of the present invention and allows for a significant improvement over the prior art within this technical field. Also, due to the contact unit 3 being able to be inserted with the female or the male end into the connector module 1, the connector module 1 can be adapted to serve the needs of any configuration of connectors 21 in the connection block 2. Further, the possibility to use the same contact unit 3 for both female and male connections mitigates the need to produce, store and handle different types of connector units.

It is to be noted that features from the embodiments described herein may freely be combined, unless it is explicitly stated that such a combination would be unsuitable.

The invention claimed is:

1. A train coupler connector module (1) for electrically coupling a first rail vehicle to a second rail vehicle, the module comprising a fixing block (11) with a back side (12) able to be mounted on an electrical train coupler, the connector module comprising a plurality of contact units (3) arranged side by side in the fixing block (11), each contact unit (3) having a first end (32) facing the back side (12) of the fixing block (11) and a second end (33) extending outwards from the fixing block (11), one of the first and second ends (32, 33) being a female contact (24) and the other being a male contact (25), wherein at least one of the contact units (3) is arranged to be individually removable from the fixing block (11) in a direction outwards from the fixing block (11), wherein the fixing block (11) is arranged to hold each contact unit (3) with either the female contact (24) or the male contact (25) facing towards the back side (12).

2. The train coupler connector module (1) according to claim 1, wherein the contact unit (3) is arranged to be mounted with either the female contact (24) or the male contact (25) facing towards the back side (12), thereby providing the respective male or the female contact towards the front side (13).

3. The train coupler connector module according to claim 1, further comprising a fixing frame (14) mounted on the fixing block (11) to fasten the contact units (3) inside the fixing block (11).

4. The train coupler connector module (1) according to claim 1 in combination with an electrical train coupler, wherein the fixing block (11) is permanently fixed to a connection block (2) of the electrical train coupler.

5. An electrical coupling for a train or for a rail vehicle, comprising at least one said train coupler connector module (1) according to claim 1.

6. The train coupler connector module according to claim 2, further comprising a fixing frame (14) mounted on the fixing block (11) to fasten the contact units (3) inside the fixing block (11).

7. The train coupler connector module (1) according to claim 2 in combination with an electrical train coupler, wherein the fixing block (11) is permanently fixed to a connection block (2) of the electrical train coupler.

8. The train coupler connector module (1) according to claim 3 in combination with an electrical train coupler, wherein the fixing block (11) is permanently fixed to a connection block (2) of the electrical train coupler.

9. The train coupler connector module (1) according to claim 6 in combination with an electrical train coupler, wherein the fixing block (11) is permanently fixed to a connection block (2) of the electrical train coupler.

10. An electrical coupling for a train or for a rail vehicle, comprising at least one said train coupler connector module (1) according to claim 2.

11. An electrical coupling for a train or for a rail vehicle, comprising at least one said train coupler connector module (1) according to claim 3.

12. An electrical coupling for a train or for a rail vehicle, comprising at least one said train coupler connector module (1) according to claim 4.

13. An electrical coupling for a train or for a rail vehicle, comprising at least one said train coupler connector module (1) according to claim 6.

* * * * *